US012624909B2

(12) United States Patent
Litzie et al.

(10) Patent No.: US 12,624,909 B2
(45) Date of Patent: May 12, 2026

(54) FIREARM BUFFER SYSTEMS

(71) Applicants: Kyle Jeffrey Litzie, Lake Forest, CA (US); Zachary Grey Smith, Coarsegold, CA (US)

(72) Inventors: Kyle Jeffrey Litzie, Lake Forest, CA (US); Zachary Grey Smith, Coarsegold, CA (US)

( * ) Notice: Subject to any disclaimer, the term of this patent is extended or adjusted under 35 U.S.C. 154(b) by 141 days.

(21) Appl. No.: 18/758,722

(22) Filed: Jun. 28, 2024

(65) Prior Publication Data

US 2026/0055980 A1 Feb. 26, 2026

(51) Int. Cl.
*F41A 3/84* (2006.01)

(52) U.S. Cl.
CPC ..... *F41A 3/84* (2013.01)

(58) Field of Classification Search
CPC ..... F41A 3/80; F41A 3/82; F41A 3/84; F41C 23/06
See application file for complete search history.

(56) References Cited

U.S. PATENT DOCUMENTS 2,731,753 A * 1/1956 Mathieu ..... F41C 23/06 42/1.06
2,767,615 A * 10/1956 Hardy ..... F41A 7/06 89/1.4
2,831,404 A * 4/1958 Sampson ..... F41A 3/78 89/44.01
3,366,011 A 1/1968 Sturtevant
3,492,749 A 2/1970 Vironda
4,972,760 A * 11/1990 McDonnell ..... F41A 3/80 89/196
6,829,974 B1 * 12/2004 Gwinn, Jr. ..... F41A 3/84 89/130
8,800,424 B2 * 8/2014 Gangl ..... F41A 3/84 89/198
9,080,823 B1 * 7/2015 Mantas ..... F41A 3/84
9,267,747 B2 * 2/2016 Caudle ..... F41A 3/84
9,341,437 B1 5/2016 Huang
9,921,013 B1 * 3/2018 Oglesby ..... F41A 3/80
10,054,378 B2 8/2018 Pawlowski
10,619,955 B2 4/2020 Wyssen
11,187,477 B2 11/2021 Snyder
11,692,785 B1 * 7/2023 Litzie ..... F41A 3/84 42/74
12,117,257 B1 * 10/2024 Vanaken ..... F41A 19/59
12,241,706 B2 * 3/2025 Zeman ..... F41A 3/84
2004/0031182 A1 * 2/2004 Bentley ..... F41C 23/04 42/74
2006/0048637 A1 3/2006 Dimitrios
2008/0110074 A1 * 5/2008 Bucholtz ..... F41C 23/06 42/1.06
2010/0122482 A1 5/2010 Simms et al.
2013/0319217 A1 * 12/2013 Gangl ..... F41A 3/84 89/198
2014/0059909 A1 * 3/2014 Caudle ..... F41A 3/84 42/1.06

(Continued)

*Primary Examiner* — Derrick R Morgan

(57) ABSTRACT

A buffer system for a firearm includes a buffer body with an internal passage, a guide rod at least partially disposed in the internal passage such that the guide rod includes a slot, a buffer bumper, an end cap, a magnet attached to the guide rod, and at least one spring. The buffer bumper and the end cap are disposed near a rear end of the guide rod. The magnet creates a force acting on the buffer body.

19 Claims, 13 Drawing Sheets

(56) References Cited

U.S. PATENT DOCUMENTS

| | | | | |
|---|---|---|---|---|
| 2017/0205164 | A1 | 7/2017 | Cassels | |
| 2019/0017765 | A1* | 1/2019 | Bender | F41A 19/44 |
| 2019/0383571 | A1 | 12/2019 | Wyssen | |
| 2021/0025665 | A1 | 1/2021 | Kincel et al. | |
| 2021/0102768 | A1 | 4/2021 | Perez | |
| 2021/0164742 | A1 | 6/2021 | Snyder | |
| 2022/0299281 | A1* | 9/2022 | Li | F41A 3/78 |
| 2023/0304765 | A1* | 9/2023 | Litzie | F41A 3/84 |
| 2024/0151483 | A1* | 5/2024 | Miller | F41A 3/86 |

* cited by examiner

FIREARM BUFFER SYSTEMS

CROSS REFERENCE TO RELATED APPLICATION

This application is related to U.S. application Ser. No. 17/575,813 ("the '813 application"), filed on Jan. 14, 2022. The '813 application is hereby incorporated in its entirety by this reference.

FIELD OF THE INVENTION

The field of the invention relates to firearms, particularly firearms with buffer systems that include at least one retained spring.

BACKGROUND

Many modern firearms (including handguns, rifles, carbines, shotguns, etc.) rely on operating systems using blowback or gas pressure (including direct gas impingement arrangements, gas piston arrangements, direct blowback, delayed blowback, or other appropriate arrangements) to move and cycle a bolt or bolt carrier group. In many cases, these systems rely on a buffer and spring system that provide mass and elastic resistance to push the bolt carrier group back into battery where the buffer and spring are located and move within a buffer tube. However, conventional buffers and buffer springs may result in inappropriate amounts of noise, motion, and/or energy during operation of the firearm.

To improve operation of the firearm, to reduce perceived recoil, to increase reliability, to reduce excess noise, and provide appropriate amounts of energy, it may be desirable to design a new buffer system that includes at least one retained spring and at least one magnet. Such a design can allow for modular firearm components to be combined with the new buffer system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a buffer system for a firearm comprises: a buffer body comprising an internal passage; a guide rod at least partially disposed in the internal passage, the guide rod comprising a slot; a buffer bumper; an end cap; a magnet attached to the guide rod; and at least one spring, wherein: the buffer bumper and the end cap are disposed near a rear end of the guide rod; and the magnet creates a force acting on the buffer body.

DETAILED DESCRIPTION

Figure 1:
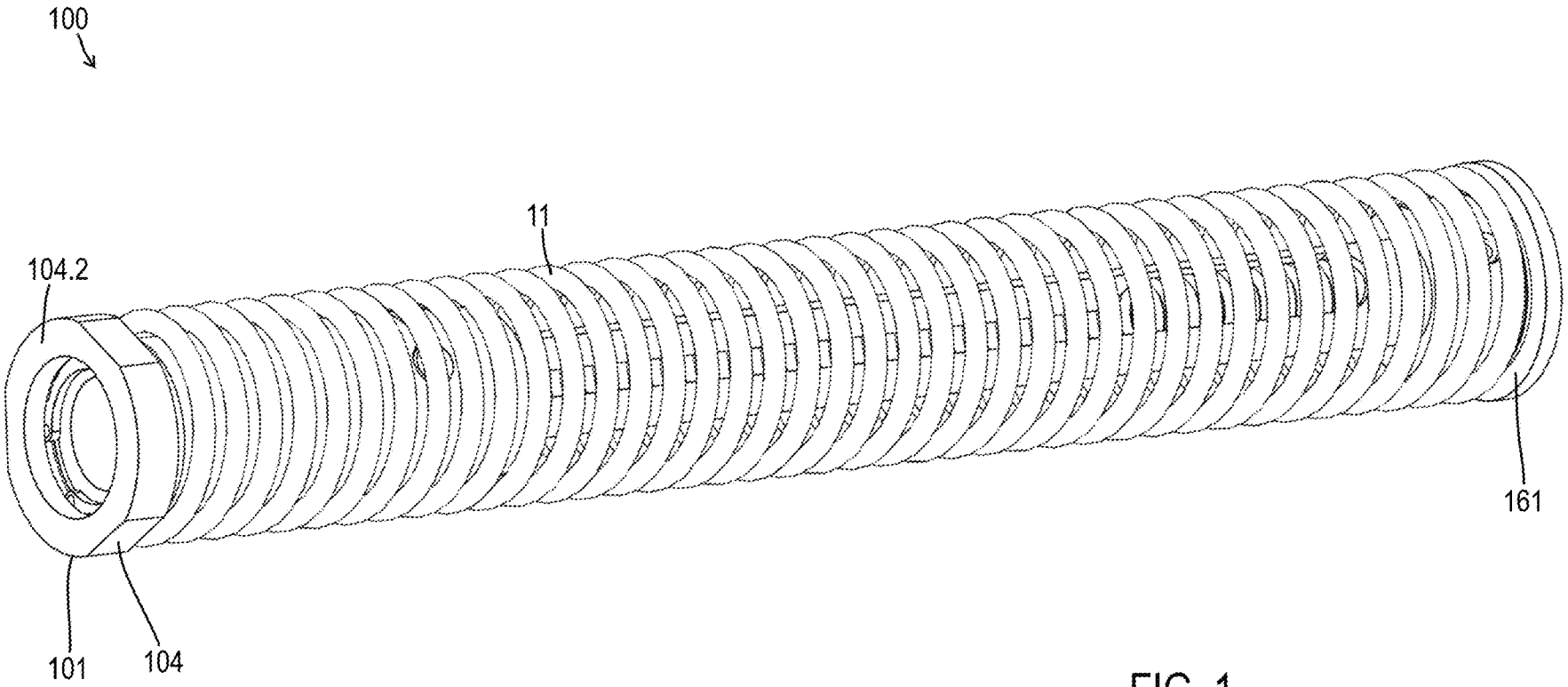
FIG. 1 is a perspective view of a buffer system for a firearm according to certain embodiments of the present invention.
Figure 2:
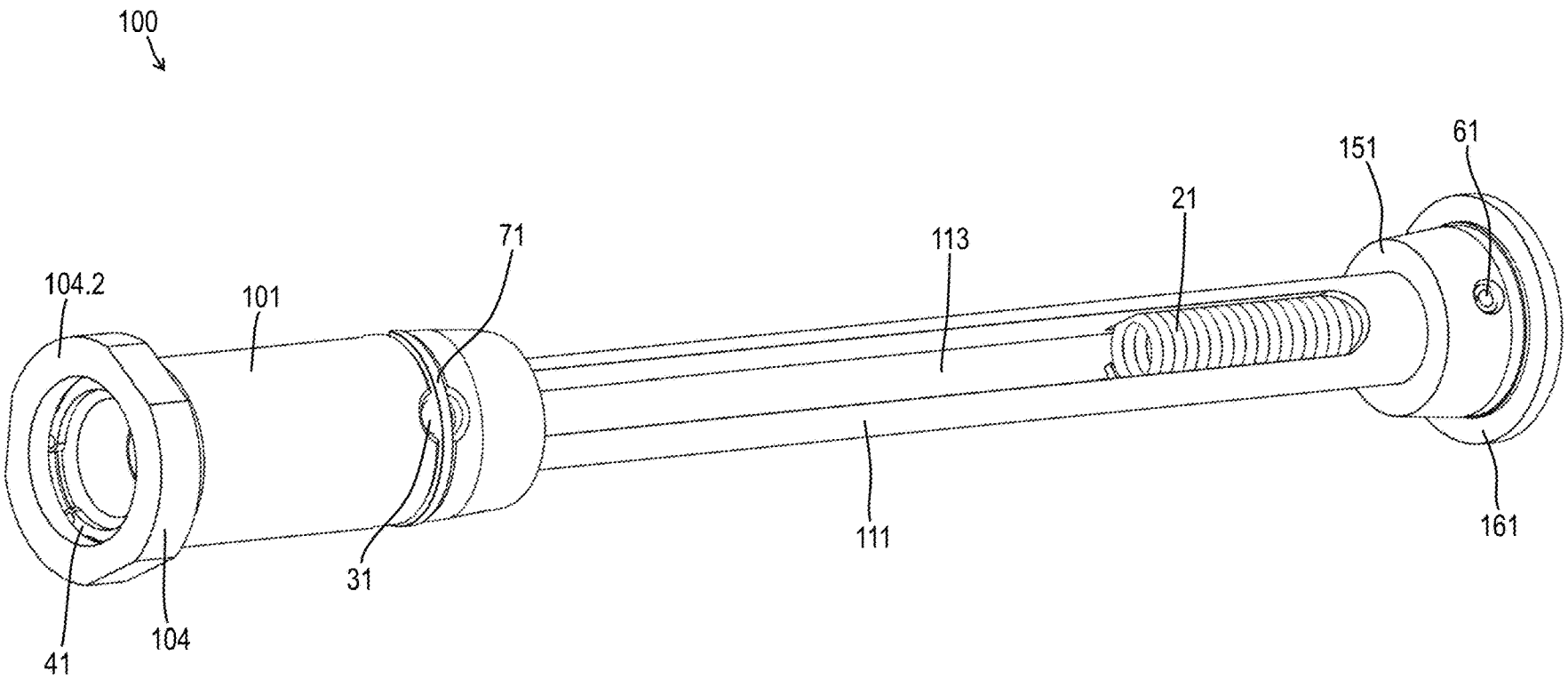
FIG. 2 is a perspective view of the buffer system of FIG. 1 without the primary spring.
Figure 3:
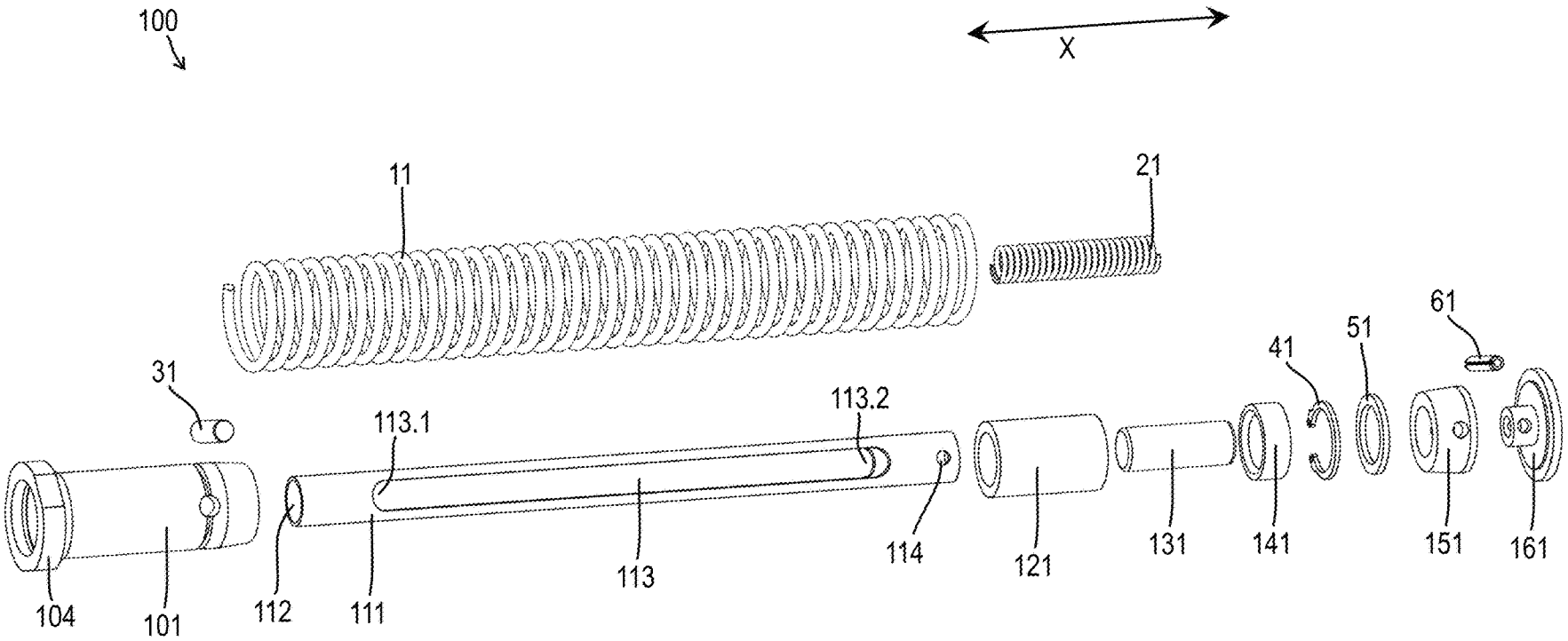
FIG. 3 is an exploded perspective view of the firearm operating system of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-13 illustrate components of various semi-automatic or automatic firearms, the features, concepts, and functions described herein are also applicable (with potential necessary alterations for particular applications) to handguns, rifles, carbines, pistols, shotguns, or any other type of firearm. Furthermore, the embodiments may be compatible with various calibers including rifle calibers such as, for example, 5.56×45 mm NATO, 0.223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

According to certain embodiments of the present invention, as shown in FIGS. 1-13, a buffer system 100 may include a buffer body 101, a guide rod 111, a buffer sleeve 121, at least one guide member 131, a spacer ring 141, a buffer bumper 151, and/or an end cap 161. The buffer system 100 may also include a primary spring 11, a secondary spring 21, a forward pin 31, a retaining ring 41, a resilient backup ring 51, a rear pin 61, and/or an external retaining ring 71. The buffer system 100 may be incorporated into a firearm that includes an upper receiver and a barrel. Some components (e.g., upper receiver, barrel, lower receiver, buffer tube, magazine, charging handle, shoulder stock, handguard, etc.) are not illustrated for simplicity. In some cases, the buffer system 100 is located within the buffer tube. The buffer system 100 may be designed as an assembly of components to fit within a standard buffer tube (attached to a lower receiver) for a known modular firearm such that the lower receiver can interface with a standard upper receiver. For example, the firearm buffer system 100 may be designed to function and engage with (i) components of AR-15 variant (civilian) or M16/M4 (military) firearms; (ii) components of AR-10 variant firearms; or (iii) components of any other relevant firearm.

Figure 4A:
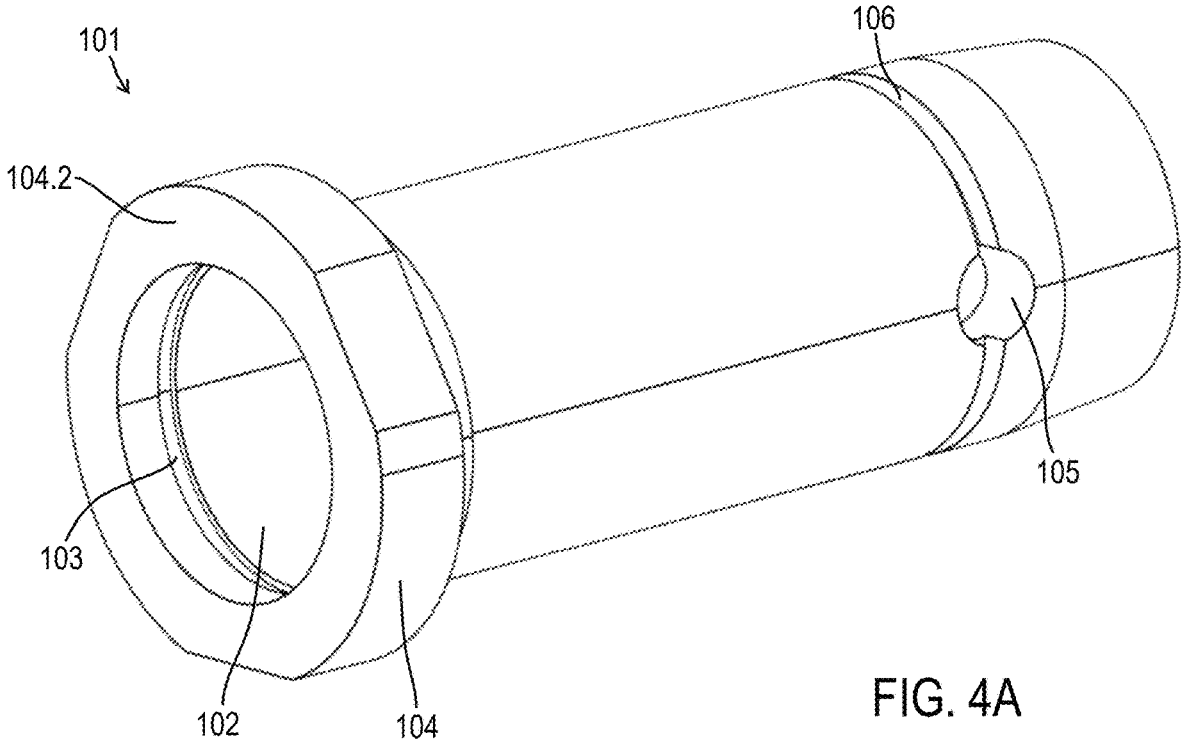
FIG. 4A is a front perspective view of a buffer body of the buffer system of FIG. 1.
Figure 4B:
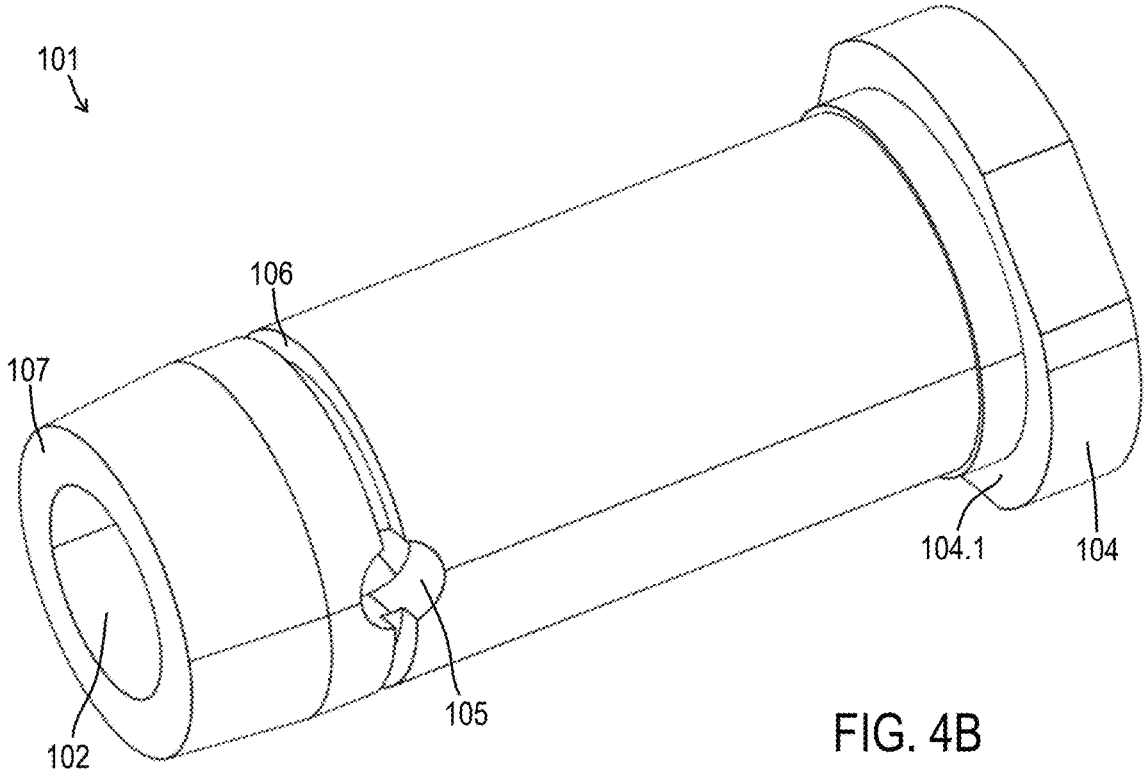
FIG. 4B is a rear perspective view of the buffer body of FIG. 4A.
Figure 5:
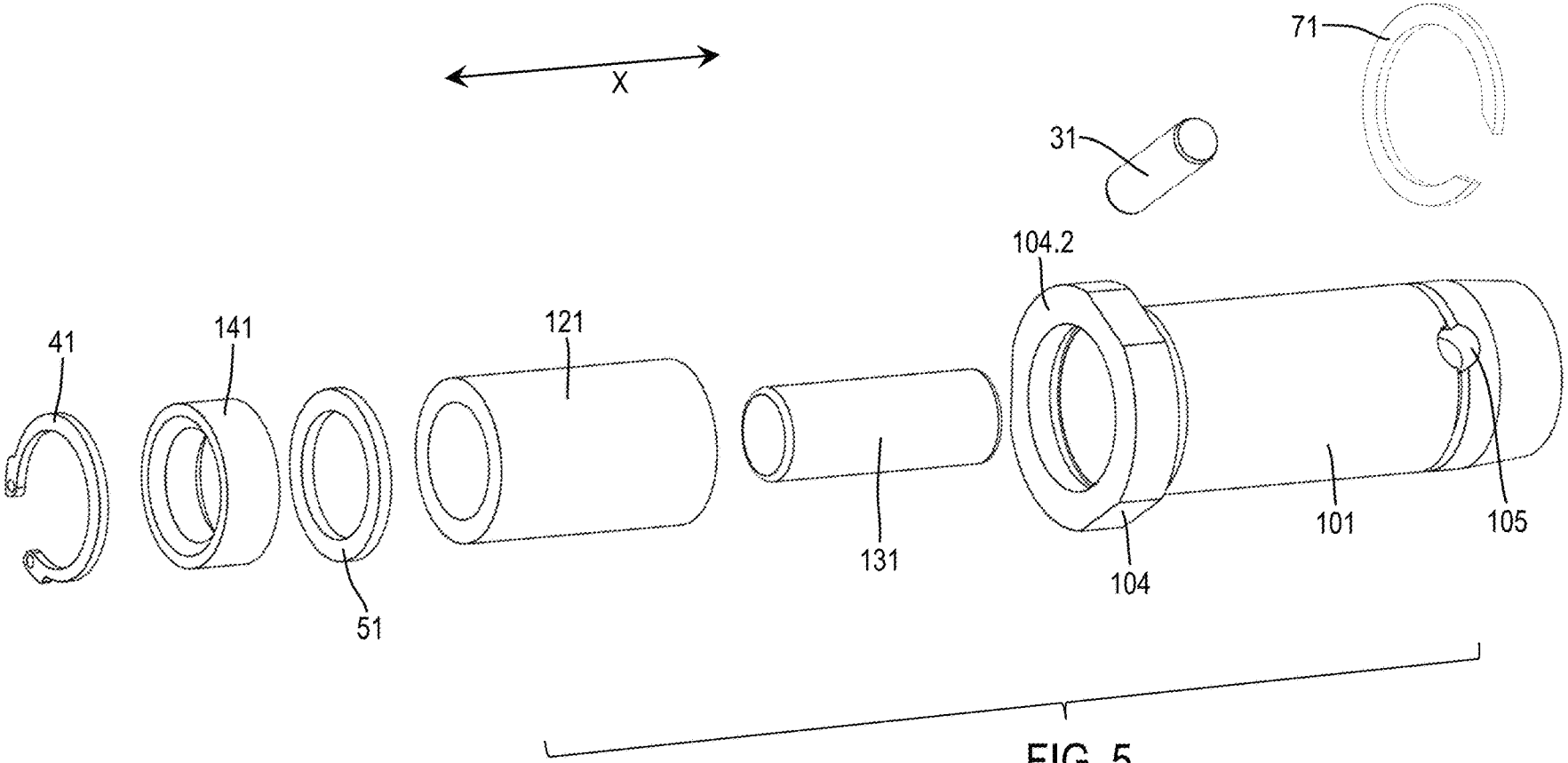
FIG. 5 is a partial exploded perspective view of the buffer system of FIG. 1.

The buffer body 101 is shown in FIGS. 4A and 4B. The buffer body 101 may include an internal passage 102, an internal groove 103, a flange 104, a pin interface 105, an external groove 106, and/or a rear surface 107. In some embodiments, one or more components are disposed within or partially within the internal passage 102 of the buffer body 101. The retaining ring 41 may engage the internal groove 103 and block at least one component from passing through the forward end of the buffer body 101. The forward pin 31 may be configured to block the at least one component from passing through the rear end of the buffer body 101, wherein the forward pin 31 is disposed within the pin interface 105. The external retaining ring 71 may be configured to retain the forward pin 31 in the buffer body 101. In some cases, the components enclosed within the buffer body 101 between the retaining ring 41 and the forward pin 31 include the spacer ring 141, the resilient backup ring 51, and/or the buffer sleeve 121. In some embodiments, in addition to passing through the pin interface 105 of the buffer body 101, the forward pin 31 is also located in the slot 113 of the guide rod 111. In such an arrangement, at least part of the guide rod 111 is also located within the internal passage 102 of the buffer body 101. The material of the buffer body 101 may be metallic, polymer, thermoplastic, and/or any other relevant material. In some embodiments, the buffer body 101 is nonferrous and includes aluminum, polymer, stainless steel, thermoplastic, rubber, and/or other relevant materials.

Figure 6A:
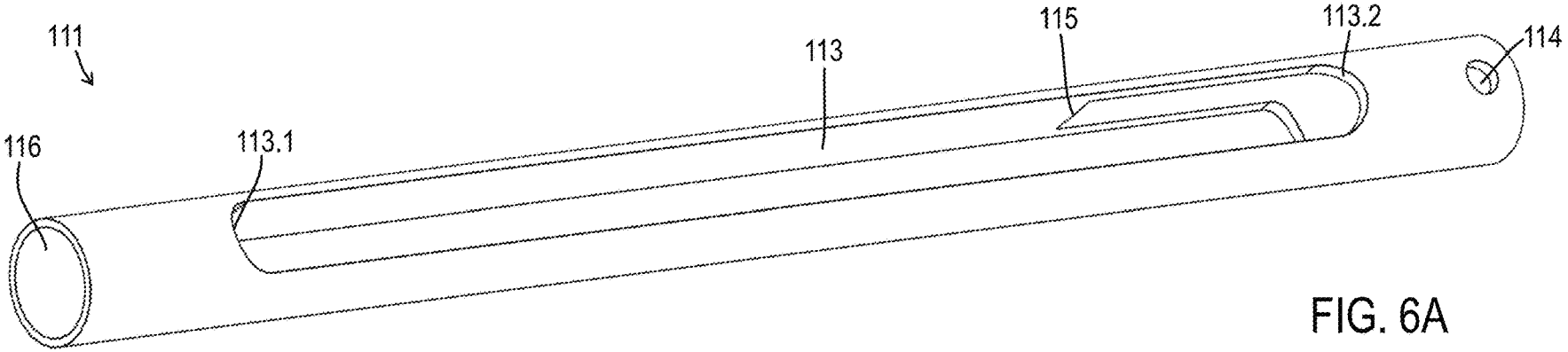
FIG. 6A is a front perspective view of a guide rod of the buffer system of FIG. 1.
Figure 6B:
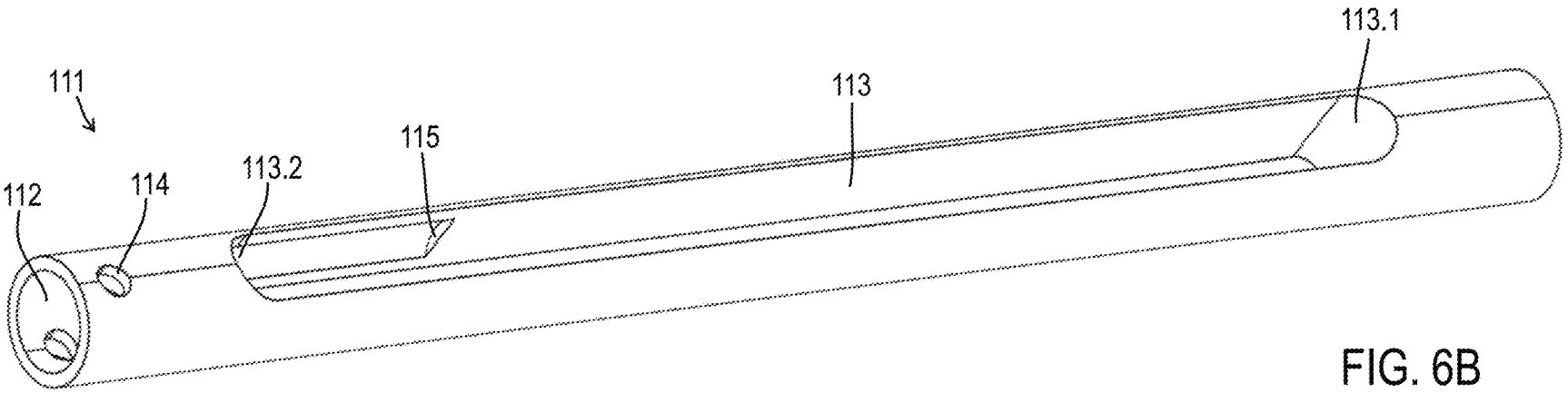
FIG. 6B is a rear perspective view of the guide rod of FIG. 6A.

As shown in FIGS. 6A and 6B, the guide rod 111 may include a rear cavity 112, a slot 113, a pin interface 114, a spring interface 115, and/or a forward cavity 116. In some embodiments, the spring interface 115 is a step such that the secondary spring 21 is constrained between the spring interface 115 and the rear pin 61 (which may extend through pin interface 114). In some cases, the rear pin 61 also passes through (i) pin interface 155 of the buffer bumper 151 and (ii) pin interface 165 of the end cap 161. The at least one guide member 131 may be at least partially disposed within the forward cavity 116. In some embodiments, there may be adhesive securing the guide member 131 in the forward cavity 116. In some embodiments, the guide member 131 is a cylindrical shape oriented with the axis in the forward/rear direction. However, the guide member 131 may be a disc shape, an annular tube shape, a cube shape, a box shape, a sphere shape, a hemisphere shape, a cone shape, an egg shape, and/or any other relevant shape.

Figure 7A:
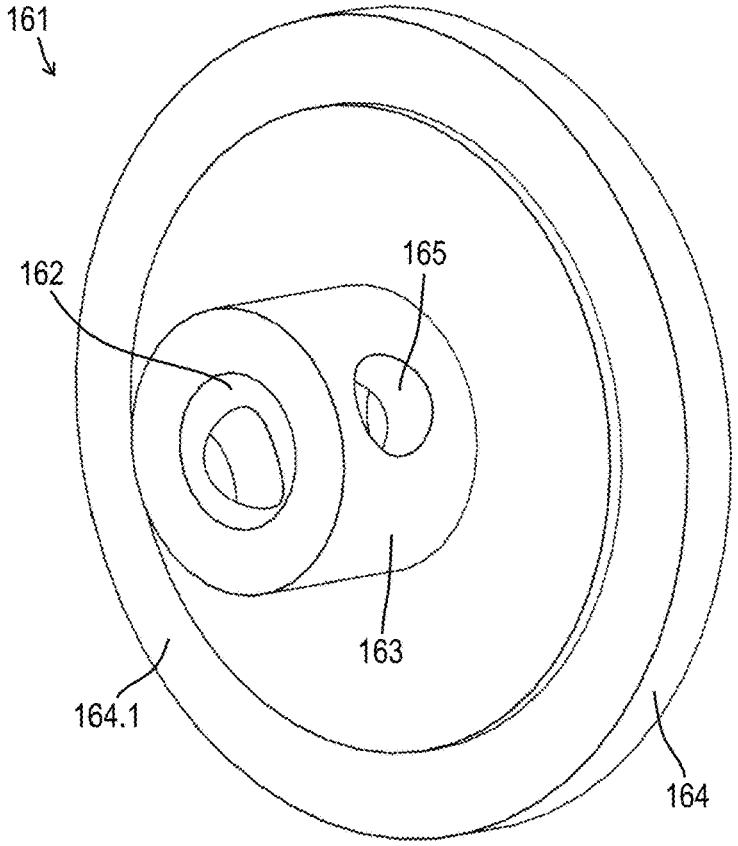
FIG. 7A is a front perspective view of an end cap of the buffer system of FIG. 1.
Figure 7B:
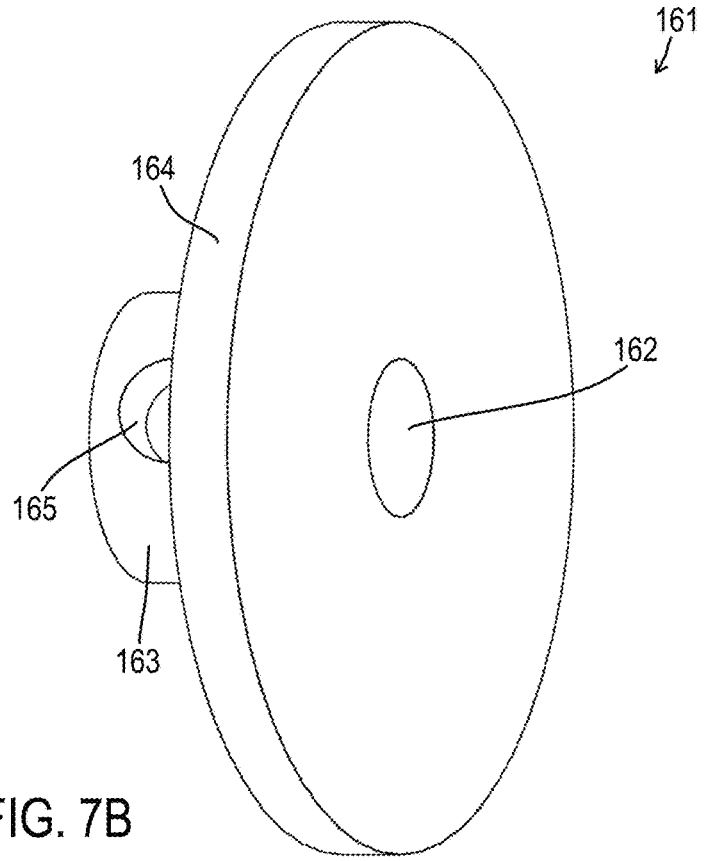
FIG. 7B is a rear perspective view of the end cap of FIG. 7A.

The end cap 161 is shown in FIGS. 7A and 7B. The end cap 161 may include an internal passage 162, a protrusion 163, a flange 164, and/or a pin interface 165. As described in more detail below, the flange 164 may include a forward surface 164.1 that interfaces with primary spring 11. In addition, the pin interface 165 may engage the rear pin 61. In some embodiments, the rear pin 61 engages at least one of (i) the pin interface 114 of the guide rod 111, (ii) the pin interface 155 of the buffer bumper 151, and/or (iii) the pin interface 165 of the end cap 161.

Figure 8:
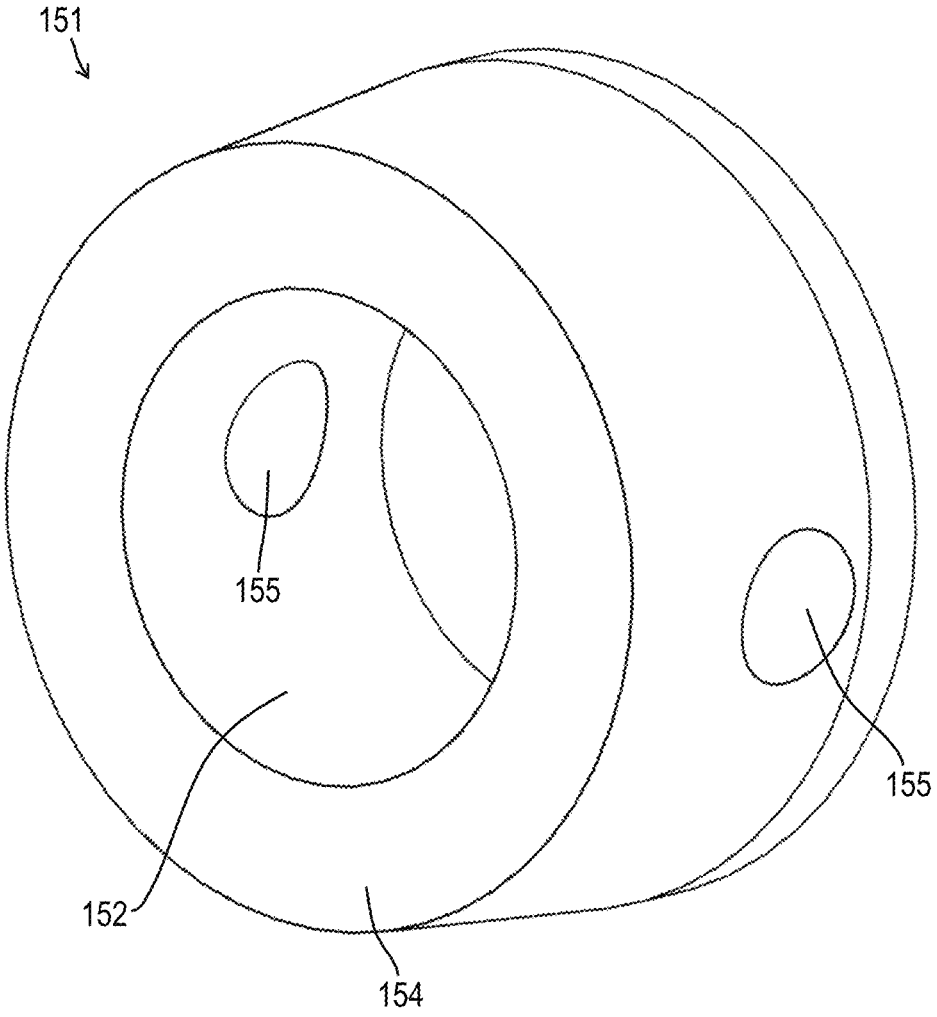
FIG. 8 is a perspective view of a buffer bumper of the buffer system of FIG. 1.

The buffer bumper 151 is shown in FIG. 8. The buffer bumper 151 may include an internal passage 152, a forward surface 154, and/or a pin interface 155. The material of the buffer bumper 151 may be metallic, polymer, thermoplastic, rubber, synthetic rubber, and/or any other relevant material. In some embodiments, the buffer bumper 151 is compliant and designed to elastically deform such that it absorbs impacts and vibration.

In some embodiments, the buffer system 100 includes a plurality of different configurations. For example, the buffer system 100 may include an extended configuration where the buffer body 101 is pushed in the forward direction by the primary spring 11 such that the forward pin 31 is closer to the forward end 113.1 of the slot 113 than the rear end 113.2 (see FIG. 1). In this configuration, the at least one guide member 131 is disposed within the internal passage 102 of the buffer body 101. In some cases, in the extended configuration, the forward pin 31 is constrained against the forward end 113.1 of the slot 113 to limit the forward travel of the buffer body 101 relative to the guide rod 111. In other cases, the buffer system 100 may have an in-battery configuration where the buffer system 100 is located in the buffer tube of a firearm where the end cap 161 is disposed at or near the rear of the buffer tube and the forward surface 104.2 of the buffer body 101 contacts a rear of the bolt carrier group. In the in-battery configuration, the rear of the bolt carrier group (in its forward-most position in battery) pushes the forward surface 104.2 to compress the primary spring 11 such that the forward pin 31 is pushed away from the forward end 113.1 of the slot 113. In other embodiments, the in-battery configuration is the same as the extended configuration.

Figure 9:
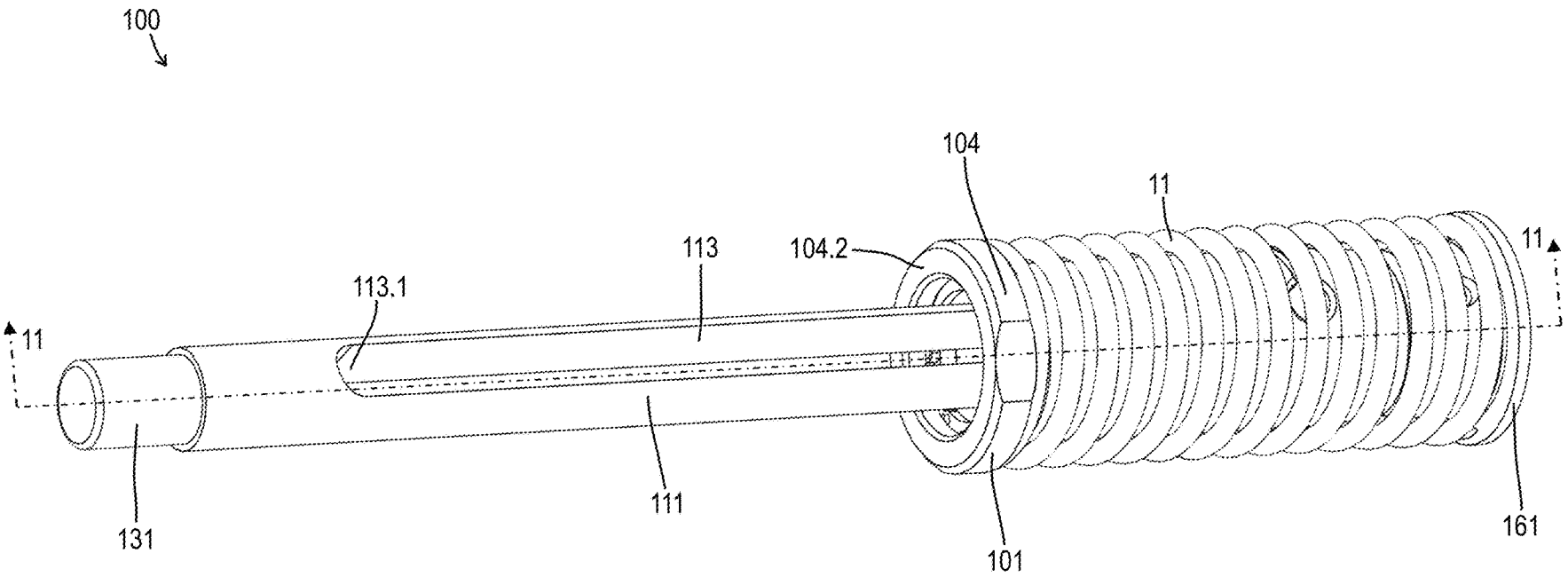
FIG. 9 is a perspective view of the buffer system of FIG. 1 in a compressed configuration.
Figure 10:
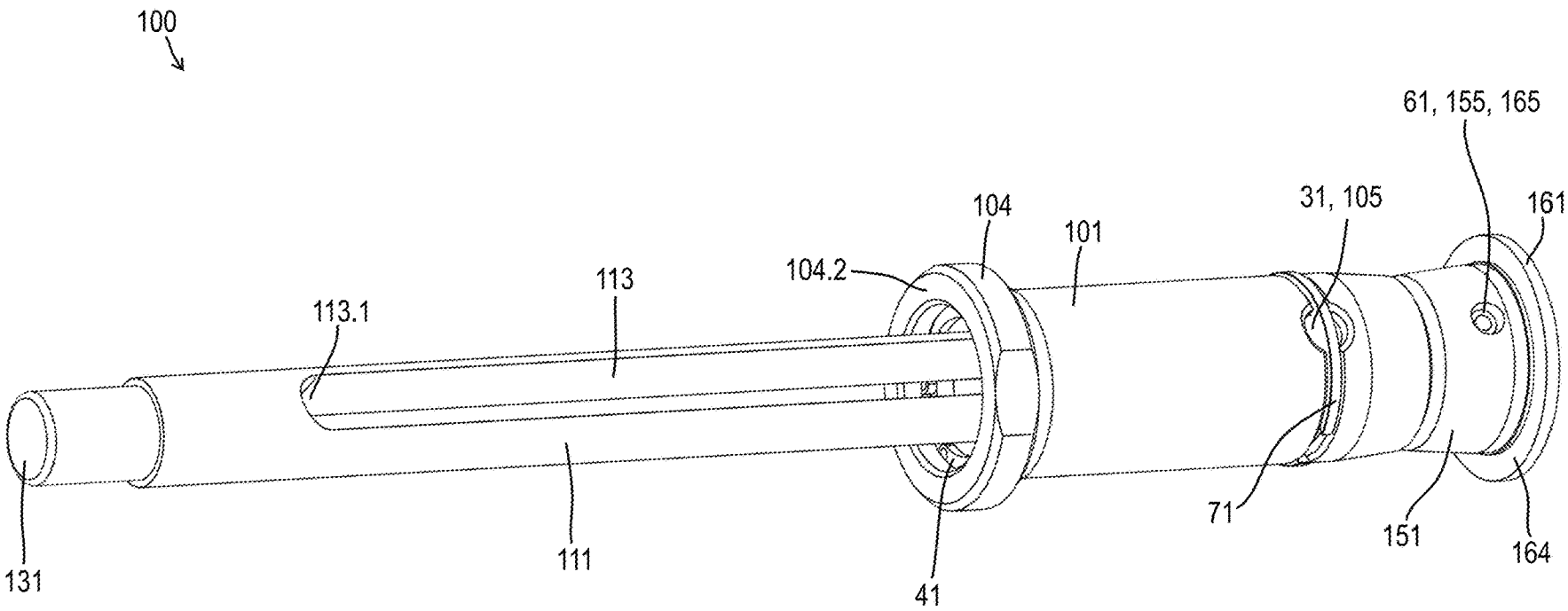
FIG. 10 is a perspective view of the buffer system in the compressed configuration of FIG. 9 without the primary spring.
Figure 11:
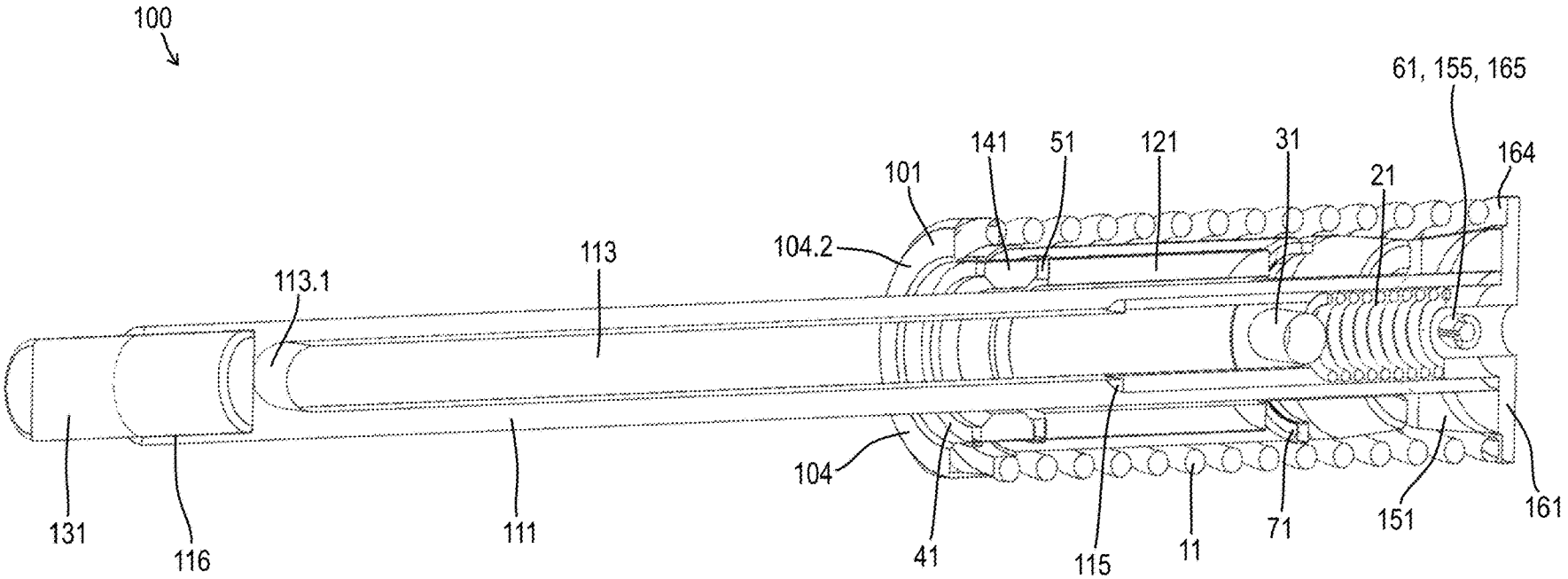
FIG. 11 is a cross-sectional view of the buffer system in the compressed configuration of FIG. 9.

The buffer system 100 may also include a compressed configuration. An example of the compressed configuration is shown in FIGS. 9-11. The bolt carrier group may include an open cavity exposed to the rear that is larger in diameter than the guide rod 111 and/or the at least one guide member 131 such that rearward movement of the bolt carrier group pushes the buffer body 101 rearward compressing at least one of the primary spring 11 and the secondary spring 21. At least a portion of the guide rod 111 and/or the at least one guide member 131 are located within the bolt carrier group in the compressed configuration. The firearm may be in the compressed configuration due to manual manipulation (i.e., movement of a charging handle), due to cycling after a round is fired, or due to other relevant situations. FIGS. 9-11 show a condition where the rear surface 107 of the buffer body 101 is in contact with the forward surface 154 of the buffer bumper 151. In some cases, this condition represents the maximum rear travel of the buffer body 101, but in other cases, the resistance of the primary spring 11 and/or the secondary spring 21 prevents the buffer body 101 from traveling far enough to the rear to contact the buffer bumper 151. In still other cases, the buffer body 101 travels further to the rear than shown because one or both of the buffer body 101 and the buffer bumper 151 include compliant material able to compress when these components make contact with one another. For example, at least a portion of the buffer body 101 and/or the buffer bumper 151 may include a material such as rubber, synthetic rubber, polymer, thermoplastic, and/or other compliant materials. Such a material would allow the component(s) to compress allowing further travel (as described above), may reduce the effect of impacts when the buffer body 101 and the buffer bumper 151 contact one another, reduce/absorb vibrations, and/or other relevant effects. Any compression of the buffer body 101 and/or the buffer bumper 151 along with any compression of the secondary spring 21 cause increased energy, velocity, and or momentum as the buffer body 101 begins travels forward.

Figure 12:
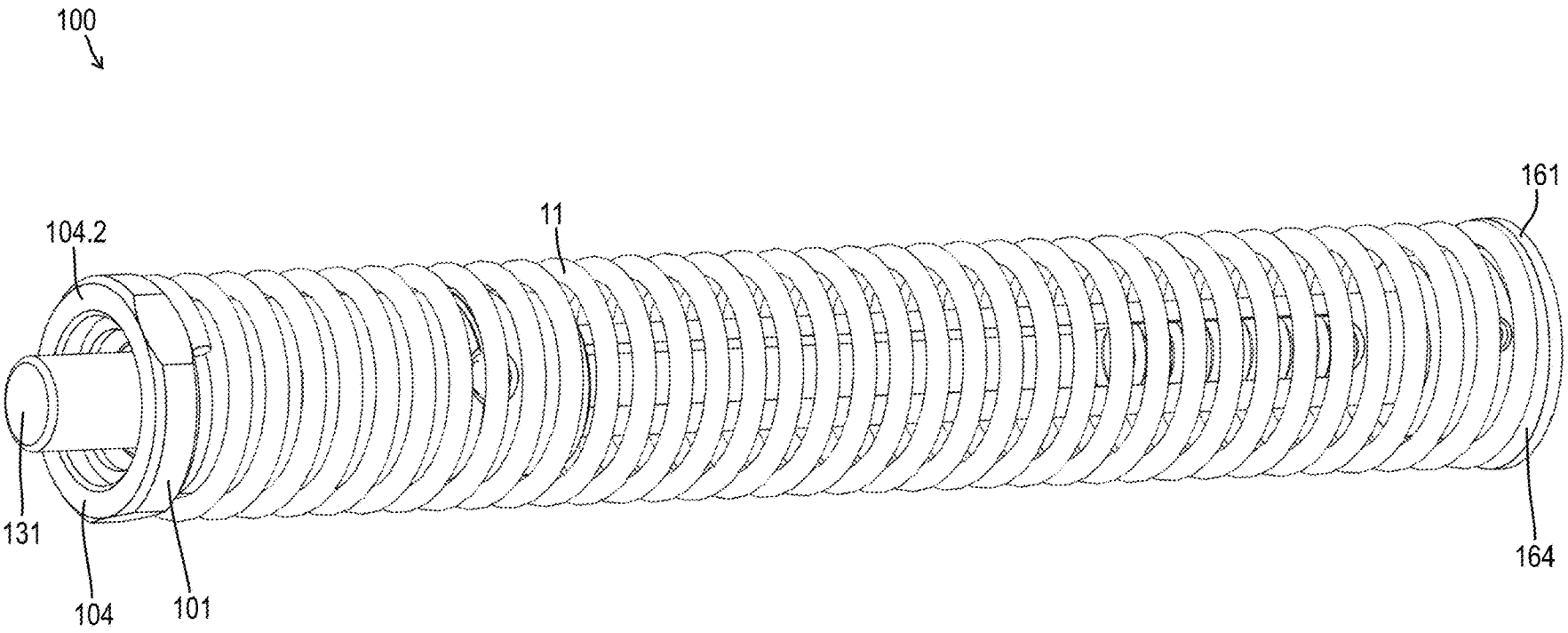
FIG. 12 is a perspective view of the buffer system of FIG. 1 in a partially compressed configuration.
Figure 13:
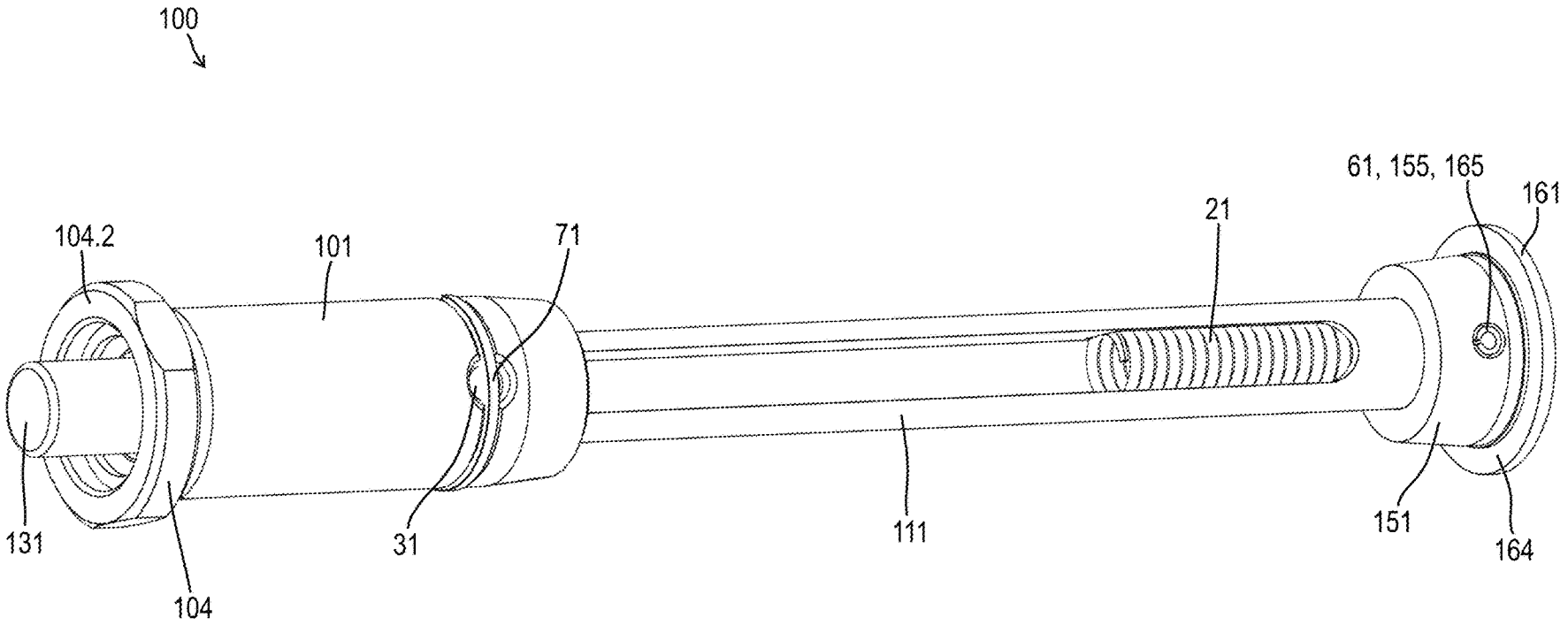
FIG. 13 is a perspective view of the buffer system in the partially compressed configuration of FIG. 12 without the primary spring.

FIGS. 12 and 13 illustrate an example of a partially compressed configuration. The buffer system 100 is in the partially compressed configuration when the buffer body 101 is located rearward of the position in the extended configuration (or the in-battery configuration) and forward of the position in the compressed configuration. In some embodiments, there are an unlimited number of positions for the buffer body 101 in the partially compressed configuration due to infinitesimal movement of the buffer body 101 between the extended configuration (or the in-battery configuration) and the compressed configuration. The partially compressed configuration shown in FIGS. 12 and 13 may represent the buffer system 100 during (i) rearward motion (moving away from the extended configuration or the in-battery configuration toward the compressed configuration) or (ii) forward motion (moving away from the compressed configuration toward the extended configuration or the in-battery configuration).

As shown in FIGS. 1, 9, 11, and 12, the primary spring 11 may be constrained or trapped between the flange 104 of the buffer body 101 and the flange 164 of the end cap 161. In some embodiments, when the buffer system 100 is assembled, the primary spring 11 is held in compression between the rear surface 104.1 of the flange 104 and the forward surface 164.1 of the flange 164 (see FIGS. 4A, 4B, 7A, and 7B). Conventional firearms often include a buffer spring that is only in compression when it is installed in the buffer tube such that the rear of the spring is pressed against the rear of the buffer tube. However, as described above, the primary spring 11 may be compressed when the buffer system 100 is fully assembled, whether or not the buffer system 100 is installed in a firearm or not. The buffer system 100 is an example of a captured buffer system. In some embodiments, the buffer system 100 includes a secondary spring 21 that is constrained or trapped between the step 115 of the guide rod 111 and the rear pin 61.

Although both the primary spring 11 and the secondary spring 21 are illustrated as constant rate (linear) springs, one or both of the primary spring 11 and the secondary spring 21 may be non-linear such that the spring(s) are progressive or dual rate such that the force required to compress the spring changes as the spring compresses. In some embodiments, one or both of the primary spring 11 and the secondary spring 21 are linear, but the buffer system 100 may act non-linear because when the forward pin 31 reaches step 115 (due to rearward movement of the buffer body 101), the secondary spring 21 begins compressing, which changes the overall spring rate of the buffer system 100. In other embodiments, the primary spring 11 is non-linear such that there is at least two distinct spring rates between the extended configuration and the point where the forward pin 31 reaches step 115. In such a situation, the secondary spring 21 adds an additional spring rate such that the buffer system 100 has at least three distinct spring rates. In some cases, the arrangement of the primary spring 11 and/or secondary spring 21 ensures there is sufficient speed or momentum when the buffer body 101 begins travelling back forward such that the bolt carrier group will be able to load the subsequent round from the magazine and push the round fully into battery.

In some cases, as shown in the drawings, the secondary spring 21 has a smaller diameter than the primary spring 11. Although the secondary spring 21 is illustrated as shorter than the primary spring 11 (approximately 25% of the primary spring 11), the secondary spring 21 may be approximately the same length as the primary spring 11. The secondary spring 21 may be approximately half the length of the primary spring 11. The secondary spring 21 may be approximately 75% of the length of the primary spring 11. In other cases, the secondary spring 21 has approximately the same diameter as the primary spring 11. In some embodiments, the secondary spring 21 and the primary spring 11 at least partially overlap one another such that there is at least a portion of the travel of the buffer body 101 where both springs are being compressed. As shown in the drawings, in some cases, the stroke of the secondary spring 21 fully overlaps with a portion of the travel of the primary spring 11.

Firearms with conventional buffer systems often exhibit problems related to feeding subsequent rounds from a magazine. In many firearms, the bolt carrier group travels rearward due to gas pressure and/or inertia created by firing a round. A conventional buffer system absorbs some of the forces imparted from firing a round and uses a single spring to push the buffer and bolt carrier group back forward. Before the bolt carrier group is pushed forward into battery, the bolt carrier group passes a magazine well of the receiver. If a magazine is present with one or more rounds, the bolt carrier group will strip the uppermost round out of the magazine and push this round into battery. Conventional buffer systems often have problems because of the resistance and/or friction created by stripping the round from the magazine and pushing the round into battery. This problem is exacerbated because the single spring of a conventional buffer is near the end of its stroke where the potential energy is reduced or near its minimum. As a result, conventional buffer systems often fail to strip a round from the magazine and/or fail to push the round fully into battery.

The buffer system 100 solves the aforementioned issues prevalent for conventional buffer systems by including features related to the at least one spring and/or the at least one guide member 131. As discussed above, the buffer system 100 may include a compound spring arrangement with (i) a single spring (primary spring 11) that is non-linear, (ii) multiple springs (e.g., primary spring 11 and secondary spring 21) that are individually linear but combine to create a non-linear system, (iii) multiple springs (e.g., primary spring 11 and secondary spring 21) where at least one is non-linear and combine to create a non-linear system. The non-linear spring arrangement ensures there is sufficient energy, momentum, and speed when the bolt carrier group reaches the magazine to strip the round and push the round fully into the chamber. In some embodiments, the guide member 131 is a magnet. As described above, the guide member 131 may be at least partially disposed within the forward cavity 116 of the guide rod 111. In some embodiments, the buffer system 100 is designed such that the only ferrous component of the buffer body assembly is the buffer sleeve 121 such that the guide member 131 and the buffer sleeve 121 are magnetically attracted to one another. The buffer body assembly may include the buffer body 101 where the retaining ring 41 is disposed within the internal groove 103 and the forward pin 31 is disposed within the pin interface 105 such that the spacer ring 141, the resilient backup ring 51, and/or the buffer sleeve 121 are restrained within the buffer body 101. The effect of the guide member 131 and the buffer sleeve 121 is that as the buffer body assembly moves forward, the guide member 131 attracts the buffer sleeve 121, which pulls the buffer body 101 into the in-battery configuration or the extended configuration (e.g., see FIGS. 1 and 2). Based on such a configuration, the magnetic force aids the bolt carrier group in pushing the new round into battery. In some cases, the geometric arrangement of the guide member 131 and the buffer sleeve 121 also ensures that the magnetic force aids the bolt carrier group in stripping the uppermost round from the magazine. The guide member 131 and the buffer sleeve 121 may also be configured to primarily act near the forward end of the stroke of the buffer body assembly where the effect of the at least one spring is reduced. In other words, the magnet force may act as a supplement to the spring force.

In some embodiments, the buffer sleeve 121 is a magnet. When the buffer sleeve 121 is a magnet, the guide member 131 may be a ferrous material such that there is a magnet force created between these parts (as described above). In other embodiments, both the guide member 131 and the buffer sleeve 121 are magnets. The coaxial arrangement of the guide member 131 and the buffer sleeve 121 allow the poles of the two magnets to be arranged such that when the two components approach one another the magnetic force snaps the buffer body assembly into the in-battery configuration or the extended configuration (e.g., see FIGS. 1 and 2). Based on such a configuration, the magnetic force aids the bolt carrier group in pushing the new round into battery. In some cases, the geometric arrangement of the guide member 131 and the buffer sleeve 121 also ensures that the magnetic force aids the bolt carrier group in stripping the uppermost round from the magazine. The guide member 131 and the buffer sleeve 121 may also be configured to primarily act near the forward end of the stroke of the buffer body assembly where the effect of the at least one spring is reduced. In other words, the magnet force may act as a supplement to the spring force.

The components of any of the firearms and buffer systems 100 described herein may be formed of materials including, but not limited to, thermoplastic, carbon composite, plastic, nylon, glass-filled nylon, polyetherimide, steel, aluminum, stainless steel, high strength aluminum alloy, tool steel, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A buffer system for a firearm, the buffer system comprising:
- a buffer body comprising an internal passage;
- a guide rod at least partially disposed in the internal passage, the guide rod comprising a slot;
- a buffer bumper;
- an end cap;
- at least one magnet; and
- at least one spring, wherein:
- the buffer bumper and the end cap are disposed near a rear end of the guide rod;
- the at least one magnet creates a force acting on the buffer body; and
- the guide rod comprises a forward cavity such that the at least one magnet fits at least partially in the forward cavity.

2. The buffer system of claim 1, wherein the at least one spring comprises a primary spring that is trapped between a flange of the buffer body and a flange of the end cap.

3. The buffer system of claim 1, wherein the at least one spring comprises a primary spring and a secondary spring.

4. The buffer system of claim 3, wherein the primary spring has at least one selected from the group of a larger diameter than the secondary spring and a longer length than the secondary spring.

5. The buffer system of claim 3, further comprising a rear pin attached to the guide rod, wherein the guide rod comprises a spring interface such that the secondary spring is trapped between the rear pin and the spring interface.

6. The buffer system of claim 3, wherein the primary spring and the secondary spring at least partially overlap one another.

7. The buffer system of claim 1, further comprising a forward pin that attaches the buffer body to the slot of the guide rod such that slot defines the length of travel of the buffer body relative to the guide rod.

8. The buffer system of claim 1, wherein the at least one magnet comprises a first magnet attached to the guide rod and a second magnet disposed in the buffer body.

9. The buffer system of claim 1, further comprising a buffer sleeve disposed in the internal passage of the buffer body, wherein:
- the buffer body comprises a nonferrous material; and
- the buffer sleeve comprises a ferrous material.

10. A buffer system for a firearm, the buffer system comprising:
- a buffer body comprising an internal passage;
- a guide rod at least partially disposed in the internal passage, the guide rod comprising a slot;
- a rear pin attached to the guide rod;
- a buffer bumper;
- an end cap;
- a primary spring; and
- a secondary spring, wherein the buffer bumper and the end cap are disposed near a rear end of the guide rod,
- wherein the guide rod comprises a spring interface such that the secondary spring is trapped between the rear pin and the spring interface.

11. The buffer system of claim 10, wherein the primary spring is trapped between a flange of the buffer body and a flange of the end cap.

12. The buffer system of claim 10, wherein the primary spring and the secondary spring at least partially overlap one another.

13. The buffer system of claim 10, wherein the primary spring has at least one selected from the group of (i) a larger diameter than the secondary spring and (ii) a longer length than the secondary spring.

14. The buffer system of claim 10, further comprising a forward pin that attaches the buffer body to the slot of the guide rod such that slot defines the length of travel of the buffer body relative to the guide rod.

15. The buffer system of claim 10, wherein the buffer bumper comprises an elastic material such that the buffer body compresses the buffer bumper when the buffer body travels to the rear.

16. The buffer system of claim 10, further comprising a buffer sleeve disposed in the internal passage of the buffer body, wherein:

the buffer body comprises a nonferrous material; and the buffer sleeve comprises at least one selected from the group of a ferrous material and a magnet.

17. The buffer system of claim 10, further comprising a magnet attached to the guide rod.

18. The buffer system of claim 17, wherein the buffer body comprises a second magnet such that the two magnet create a force that pulls the buffer body to an in-battery configuration.

19. A buffer system for a firearm, the buffer system comprising:

a buffer body comprising an internal passage;

a guide rod at least partially disposed in the internal passage, the guide rod comprising a slot;

a buffer bumper;

an end cap;

a first magnet attached to the guide rod and a second magnet disposed in the buffer body; and at least one spring, wherein:

the buffer bumper and the end cap are disposed near a rear end of the guide rod; and at least one of the first magnet and the second magnet creates a force acting on the buffer body.

* * * * *